US005761256A

United States Patent [19]

Inoue et al.

[11] Patent Number: 5,761,256

[45] Date of Patent: Jun. 2, 1998

[54] CURVED PYROLYTIC GRAPHITE MONOCHROMATOR AND ITS MANUFACTURING METHOD

[75] Inventors: Takao Inoue, Hirakata; Naomi Nishiki, Kyoto; Mutsuaki Murakami, Machida; Eiichiro Matsubara, Dai 2 Kume Manshon 4-16, 1, Takanonishibiraki-cho, Sakyo-ku, Kyoto-shi, Kyoto-fu, all of Japan

[73] Assignees: Matsushita Electric Industrial Co., Ltd., Osaka-fu; Eiichiro Matsubara, Kyoto-fu, both of Japan

[21] Appl. No.: 796,918

[22] Filed: Feb. 7, 1997

[51] Int. Cl.[6] ..... G21K 1/06

[52] U.S. Cl. ..... 378/84; 378/82

[58] Field of Search ..... 378/82–85

[56] References Cited

U.S. PATENT DOCUMENTS

| | | | |
|---|---|---|---|
| 4,788,703 | 11/1988 | Murakami et al. | 378/84 |
| 5,315,113 | 5/1994 | Larson et al. | 378/84 |

FOREIGN PATENT DOCUMENTS

| | | |
|---|---|---|
| 4-120500 | 4/1992 | Japan . |
| 5-180992 | 7/1993 | Japan . |

OTHER PUBLICATIONS

Murakami et al., "High–Quality And Highly Oriented Graphite Block From Polycondensation Polymer Films", Carbon, vol. 30, No. 2, pp. 255–262, 1992, Great Britain.

*Primary Examiner*—Craig E. Church

*Attorney, Agent, or Firm*—Wenderoth, Lind & Ponack, L.L.P.

[57] ABSTRACT

A curved pyrolytic graphite crystal x-ray monochromator has at least one diffraction surface of graphite crystal for diffracting and monochromizing x-rays generated from an x-ray source so as to bend and/or converge the diffracted and monochromized x-rays, wherein the diffraction surface has a predetermined curved surface. In a method for manufacturing a curved pyrolytic graphite crystal x-ray monochromator, one or more pieces of polymer films are heated at a temperature predetermined in a range from 400° C. to 3500° C. so as to form carbonaceous films, and then, one or more pieces of formed carbonaceous films are superimposed, heated and pressed onto a predetermined curved surface of an isotropic graphite die at a temperature predetermined in a range from 400° C. to 3500° C., while applying a predetermined pressure onto the carbonaceous films provided on the isotropic graphite die, thereby forming the curved pyrolytic graphite x-ray monochromator of graphite crystal having a resulting curved surface corresponding to the predetermined curved surface.

7 Claims, 8 Drawing Sheets

CURVED PYROLYTIC GRAPHITE MONOCHROMATOR AND ITS MANUFACTURING METHOD

BACKGROUND OF THE INVENTION

1. Field of the Invention

The present invention relates to a curved pyrolytic graphite monochromator, more particularly, to a pyrolytic graphite monochromator with parabolic, cylindrical, spherical or toroidal surfaces, and also to a method for manufacturing these curved pyrolytic graphite monochromators.

2. Description of the Related Art

X-ray diffraction techniques are widely used for quantitative structural analyses and for quantitative chemical analyses by fluorescent radiations. The structural and chemical information for materials represents the average one over the area irradiated by x-rays. In order to obtain only the information from a small area, therefore, the size of the incident x-rays is limited to the corresponding small area by a pin-hole slit. In this way, the information from a small area is obtained though the incident x-ray intensity is extremely reduced. Consequently, for such measurements, a high intensity x-ray generator and/or specially designed detectors with a large solid angle are required. Recently, the x-rays with small divergent beams are converged to a small area, utilizing the total external reflection phenomenon. X-rays are totally reflected with an extremely small glancing angle. This is, therefore, appropriate to the small divergent beams, such as the synchrotron radiation source, but not to the large divergent beams from the conventional x-ray source, such as the sealed-x-ray tube or the rotating anode x-ray generator. The Pyrolytic graphite is extensively used for x-ray monochromators because of its excellent spectral and reflective characteristics with respect to x-rays. Specifically a singly-bent pyrolytic graphite monochromator is widely used because of its effective x-ray focusing to increase the intensity of the monochromatic x-ray beams.

The amount of production of high-quality natural pyrolytic graphite is extremely limited and furthermore this natural graphite occurs in a form of powder or extremely small blocks. It is apparent that this natural graphite is not appropriate for x-ray optics.

There has been a method for manufacturing artificial pyrolytic graphite. The hydrocarbon gas decomposed at high temperature is deposited and subsequently annealed. This deposited graphite is pressed and annealed for a long time at 3400° C. The graphite produced by this method is called highly-oriented pyrolytic graphite (HOPG). The properties of this graphite are superb and nearly equal to the natural graphite. In this method, the pyrolytic graphite of a considerably large size can be produced although its cost is extremely high because of the complicated manufacturing process and low yield. By this method, a curved pyrolytic graphite is produced by creaping the produced graphite plate under pressure at high temperature. Therefore, only a singly-bent pyrolytic graphite monochromator with a small curvature is barely produced. A singly-bent pyrolytic graphite with a large curvature is hardly produced, not to speak of a doubly-bent pyrolytic graphite or more complicatedly curved graphites.

Various manufacturing processes have been tried to improve the process and to reduce the cost. Among these processes, a method by which some organic or carbonaceous substances are heated at about 3000° C. has been carried out successfully. This method, however, is unable to obtain graphite whose properties are as good as those of the natural graphite. For example, the electrical conductivity perpendicular to the basal plane of graphite crystal cell, which is typically $1\times10^4$ to $2.5\times10^4$ S/cm for the natural graphite, is $1\times10^3$ to $2\times10^3$ S/cm. This implies that graphitization is not completed in the above method. Incomplete graphitization indicates the difficulty to obtain uniformly graphitized organic or carbonaceous substances.

In the above method, the structures of carbon produced by heating coke and charcoal up to about 300° C. are diverse, from those resembling the natural graphite to those different from it, although similar starting materials, such as carbonaceous substance of coke and the like, and a binder of coal tar and the like, are used. The carbons which are transformed to the graphite by a simple heat treatment are called graphitizable carbon and those not to be easily changed to the graphite are called non-graphitizable carbon. Namely, the structure of the carbon is closely related to the graphitization process. In other words, it depends on whether it is easy to remove structural defects present in carbon precursor by a heat treatment at higher temperature.

Except the coke and the like, polymer materials are also used as the starting materials. In this method, the fine structure of the carbon precursor is controlled by selecting the molecular structure of the polymer materials.

In this method, a polymer is heat-treated in vacuum or in the inert gas atmosphere and converted to the carbonaceous substance by decomposition and polycondensation reactions. This carbonaceous substance is graphitized. In this method, however, a yield rate to obtain the graphite film is not high even if the optimum polymer is used as the starting materials. In other words, this method very much depends upon each engineer's experience and intuition. Examples of polymer films which have been attempted for the above graphitization method are phenol formaldehyde resin, polyparaphenylene, polyparaphenyleneoxido, polyvinyl chloride and the like. All these polymers, however, belong to the non-graphitizable materials and did not yield a high graphitization percentage.

SUMMARY OF THE INVENTION

The object of the present invention is to provide a pyrolytic graphite monochromator with various shapes by which monochromatic x-rays are diffracted in any directions.

Another object of the present invention is to provide a method for manufacturing these curved pyrolytic graphite monochromators.

According to one aspect of the present invention, there is provided a curved surface pyrolytic graphite monochromator comprising a parabolic, spherical, cylindrical or toroidal surface.

With the cylindrically and parabolically curved pyrolytic graphite monochromator, x-rays or neutrons are converged into a predetermined line or point, respectively.

The above-mentioned curved monochromators are also produced by combining small pieces of curved pyrolytic graphite plates.

According to another aspect of the present invention, there is provided a method for manufacturing a curved pyrolytic graphite monochromator including the following steps:

first, heating one or more pieces of polymer films at a temperature predetermined in a range from 400° to 3500° C. so as to obtain carbonaceous films; and secondly, pressing one or more pieces of the obtained carbonaceous films onto a predetermined curved surface of an isotropic graphite dies and heating them at a temperature from 400° to 3500° C. Thereby a curved pyrolytic graphite monochromator is produced.

In the above manufacturing method, the applied pressure is from 10 to 1000 kg/cm$^2$.

In the above manufacturing method, the applied pressure is from 10 to 20 kg/cm$^2$ when the carbonaceous films are heated at a temperature from 400° to 2200° C., and the applied pressure is from 20 to 1000 kg/cm$^2$ when the carbonaceous films are heated at a temperature from 2200° to 3500° C.

In the above manufacturing method, each polymer film is selected from polybenzothiazole, polybenzobisthiazole, polybenzoxazole, polybenzobisoxazole, polyamideimide, polybenzoimidazole, polybenzobisimidazole, polyterephthalamide, polyphenylene vinylene, aromatic polyimide, aromatic polyamide, and polyoxadiazole.

The advisable curved surfaces obtained by this method are parabolic, cylindrical, spherical, and toroidal surfaces.

By the curved pyrolytic graphite in the present invention, x-ray beams are bent to desired directions. In particular, by one or assembled curved pyrolytic graphite in a toroidal form, x-ray beams are converged to a small predetermined area without excessively loosing the intensity like the method with a pinhole slit. In addition, since the beams are bent by diffraction by the graphite (002) plane, the x-rays are monochromatized as well as converged. Consequently, this toroidally curved pyrolytic graphite monochromator in the present invention improves the counting statistics of measurement data and their quantitativeness in comparison with the conventional method with a pinhole slit.

According to another aspect of present invention, the manufacturing method is characterized by preparing a polymer film for graphitization and manufacturing pyrolytic graphite monochromator. The curved pyrolytic graphite monochromator can be also produced by utilizing the present graphitation process.

In addition, according to the present invention, a thick curved pyrolytic graphite block which provides excellent properties including better rocking characteristics can be manufactured by heating the films pressed onto the graphite dies of a desirable shape such as a paraboloid, a sphere, a cylinder, a toroido, etc. In this process, the films are heated at more than 400° C. while they are continuously or intermittently pressed over 10 kg/cm$^2$.

BRIEF DESCRIPTION OF THE DRAWINGS

The objects and features of the present invention will become clear in the following description taken in conjunction with the preferred embodiments with reference to the accompanying drawings:

FIGS. 3A, 3B, 3C, 3D, 3E and 3F are perspective views of a toroidally curved pyrolytic graphite monochromator according to a preferred embodiment of the present invention, wherein FIGS. 3A and 3B are the front and side views of the toroidal monochromator, FIGS. 3C and 3D are the front and side views of one of the four components, respectively, when the toroidal monochromator is divided into four equivalent parts, and FIGS. 3E and 3F are the front and side views of one of the eight components, respectively, when the toroidal monochromator is divided into eight equivalent parts;

DETAILED DESCRIPTION OF THE PREFERRED EMBODIMENTS

Figure 1:
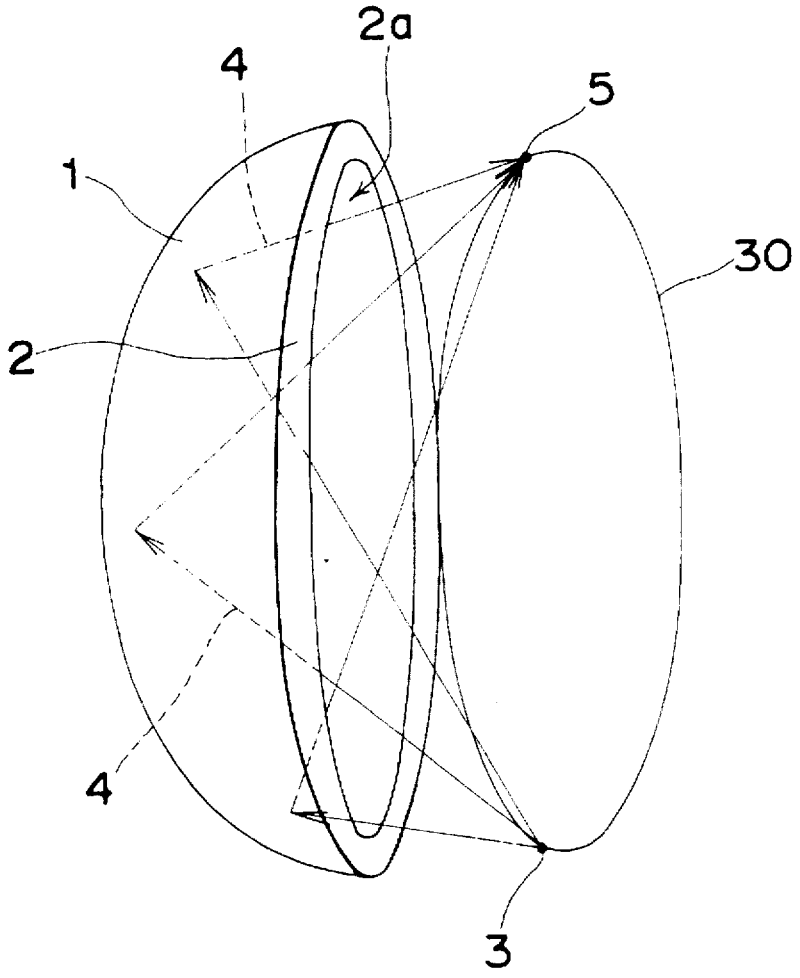
FIG. 1 is a schematic perspective view of a spherically curved pyrolytic graphite monochromator according to a preferred embodiment of the present invention.
Figure 2:
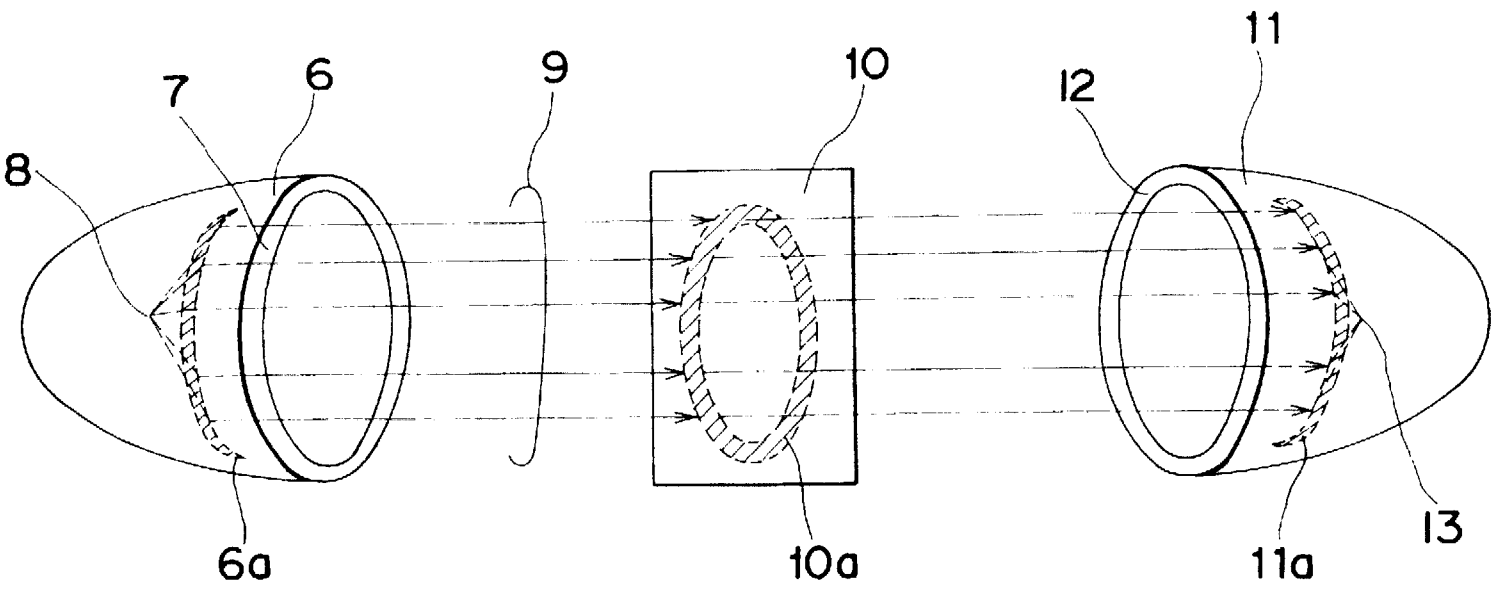
FIG. 2 is a perspective view of a paraboloidally curved pyrolytic graphite monochromator according to a preferred embodiment of the present invention.

The preferred embodiments according to the present invention will be described as follows with reference to the attached drawings.

The inventors of the present invention have undertaken various studies in order to solve the above-mentioned problems in manufacturing the graphite using polymers and attempted the graphitization of a wide variety of polymers. Then the present inventors have found that a film-shaped polymer made of a compound selected from the group consisting of polybenzothiazole (PBT), polyamideimide (PAI), polybenzoimidazole (PBI), polybenzobisimidazole (PBBI), polyterephthalamide (PTA), polyphenylene vinylene (PPV), aromatic polyamide (PA), three types of polybenzobisthiazole (PBBT), polybenzoxazole (PBO), polybenzobisoxazole (PBBO), polythiazole (PT), aromatic polyimide (PI), and other polymers is more easily graphitized than the conventionally known polymers when they are heat-treated at specified temperatures. Based on these findings, the present inventors applied for patents, and these are disclosed in the Japanese Patent Application Laid Open Nos. 61-275114, 61-275115, 61-275117, and the like. By this method, graphite crystal with a high graphitization percentage can be easily manufactured in a short time by heating the above-mentioned polymers at 1800° C. or higher, and more preferably, at 2500° C. or higher.

In order to indicate the degree of graphitization, parameters by x-ray analyses such as a lattice constant, a crystalline size along the C-axis which is the thickness direction, or graphitization percentage calculated from x-ray diffraction peaks are commonly used as well as electrical conductivity. The lattice constant is calculated from the position of the peak diffracted from the graphite (002) plane. The pyrolytic graphite structure is more developed as the lattice constant is closer to the film of the natural single crystal graphite, 6.708 Å. The crystalline size along the C-axis is evaluated from the FWHM (full width at half maximum) of the 002 peak. The graphite planar structure is more developed as the FWHM value of the peak is smaller. Incidentally, the crystalline size of the natural single crystal graphite is 1000 Åor larger. The graphitization percentage is calculated from the interlayer spacing ($d_{002}$) (See Les Carbons, Vol. 1, P. 129, 1965). The graphitization percentage of the natural graphite is naturally 100 %. The electrical conductivity across the a–b plane in the natural graphite is large. The typical value of the electrical conductivity of the natural single crystal graphite is $1\times10^4$ to $2.5\times10^4$ S/cm.

In addition, as one of the x-ray diffraction parameters to evaluate the graphite structure, there is a rocking profile which suggests the way how a–b planes are stacked each other. This is obtained by rocking the graphite crystal at 002 peak for the monochromatic parallel x-ray beams. The smaller the FWHM value evaluated from the rocking profile, the more orderly stacked the a–b planes are.

According to the preferred embodiments of the present invention, the curved pyrolytic graphite is primarily intended to be used with the ordinary x-ray generator which produces x-rays divergent from the focal point on the x-ray target. These divergent x-ray beams are converged by a pyrolytic graphite in a toroidal form without excessively loosing the intensity. This makes the quantitative x-ray diffraction analyses from a small area, easier than the method with a pinhole accompanied by a great loss of the intensity. In addition, monochromatic convergent beams are obtained by the present toroidal pyrolytic graphite monochromator. This improves the quantitativeness of the observed data in comparison with the method using a pinhole.

In addition, the method for manufacturing graphite from specific polymer films is a markedly excellent method which enables easy and low-cost manufacturing, and in particular, it has been revealed that homogeneous graphitization is carried out in each plane. The subsequent investigations carried out on this method have suggested that there are the following several problems to be improved in order to manufacture a pyrolytic graphite having a curved surface such as a sphere, a cylinder, a parabola and a toroid.

The graphitization reaction strongly depends on the material thickness. The present inventors have grappled with the manufacturing method of a curved pyrolytic graphite such as a spherical, cylindrical, parabolic or toroidal surface, by further developing the above-mentioned technique.

The subject matter of this invention is to improve a process in which graphitization of film takes place in the parallel film planes and to solve graphitization along each curved surface such as spherical, parabolic, toroidal and cylindrical ones, and the like (hereinafter generically called "a curved surface"). In particular, the subject matter of the present invention is provided for solving a problem by dramatically enhancing the intensity of divergent x-rays using the manufacturing method of the present invention.

EXAMPLE 1

In the preferred embodiments of the present invention, as a polymer film used as the starting material, there is used a polymer film made of a polymer selected the group consisting of:

(a) polyimide such as aromatic polyimide, various kinds of polyimide and the like;

(b) polyamide such as aromatic polyamide and the like; and (c) polyoxadiazole.

Examples of the above-mentioned various types of polyimide include polybenzothiazole, polybenzobisthiazole, polybenzoxazole, polybenzobisoxazole, polyamideimide, polybenzoimidazole, polybenzobisimidazole, polyterephthalamide, polyphenylene vinylene, and further, aromatic polyimide includes a compound represented by the following general formula (1).

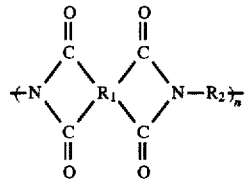

(1)

where $R_1$ =

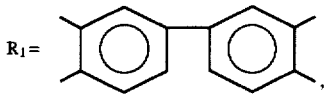

(2)

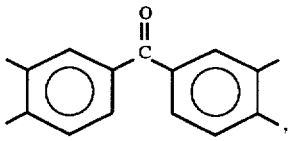

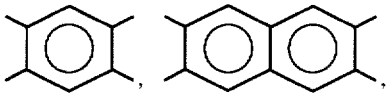

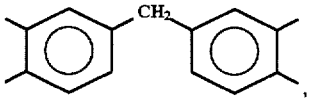

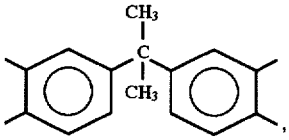

or

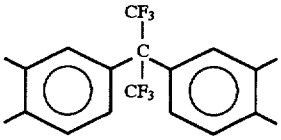

$R_2$ =

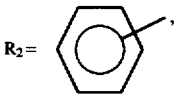

(3)

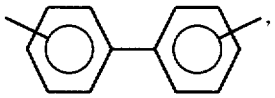

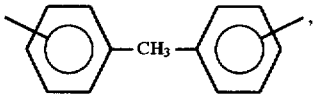

or

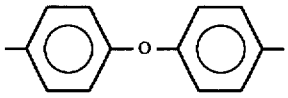

Examples of the above-mentioned various types of polyamide include aromatic polyamide represented by the following general formula (4).

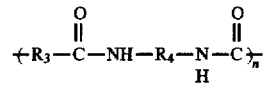

(4)

where

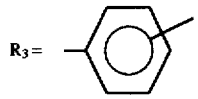

(5)

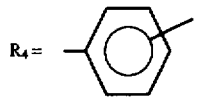

(6)

The concrete material composition and compounding of polymer films are chosen and processed as it is required in applications and manufacturing conditions. The thickness of the polymer film is not more than 400 μm, and preferably 1 μm to 400 μm. When the thickness of polymer film is thicker than 400 μm, the carbon precursor with disturbed internal structure (that is, non-graphitizable carbon) is produced due to the gas produced in the process of carbonization and graphitization. Therefore, even if the process for heating and pressing the polymer against the dies with a shape of a part of the curved surface is carried out thereafter, no high-quality graphite is obtained. When the film thickness becomes thinner than 1 μm, it is necessary to manufacture a larger number of carbonaceous films. This is not practical from the economical point of view.

The heat treatment for manufacturing carbonaceous film is carried out in a range from 400° to 3500 ° C., preferably in a range from 400° to 2000° C. We confirmed that the structure of the graphite crystal is not broken even at 3500° C. It is possible to carry out the heat treatment in a temperature range of 2000° C. or higher. However, in order to produce better monochromator the quality of graphite is critical. The polymer films are heat-treated within the above-mentioned temperature range and hot-pressed against the isotropic graphite dies having a shape corresponding to a curved diffraction surface of a part or a whole of a parabolic, spherical, cylindrical, and toroidal surfaces.

Figure 3B:
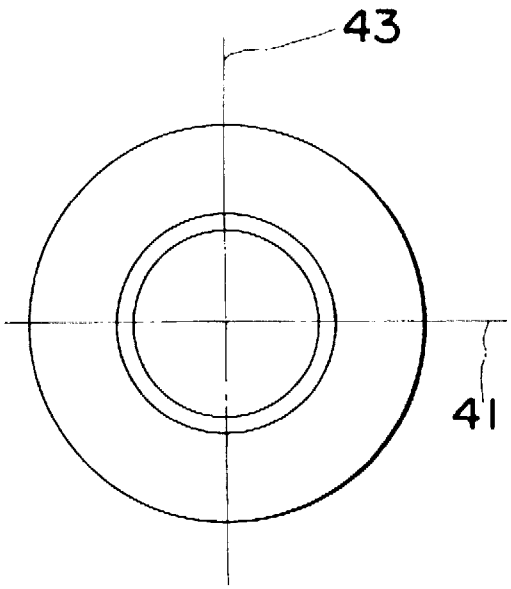
Figure 3A:
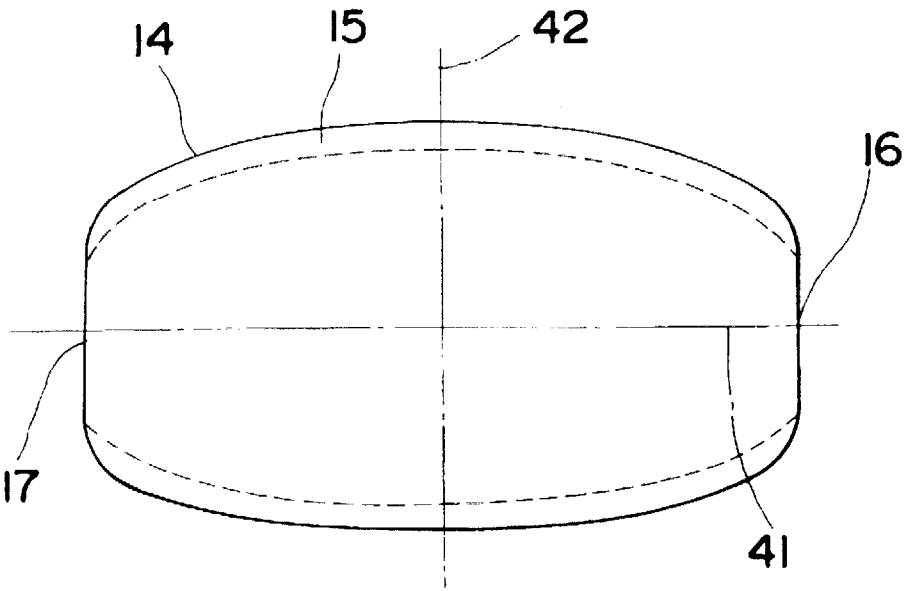
Figure 3D:
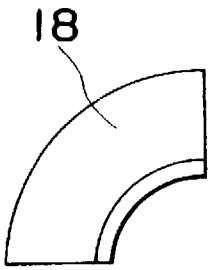
Figure 3C:
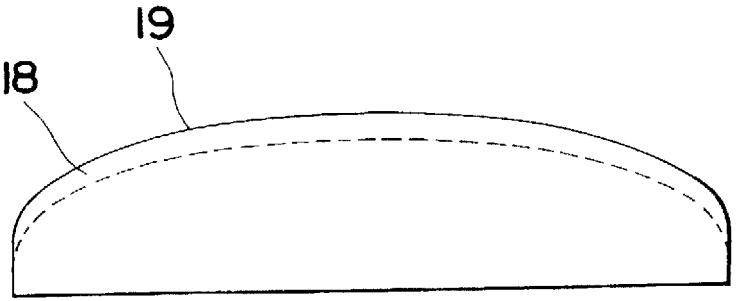
Figure 3F:
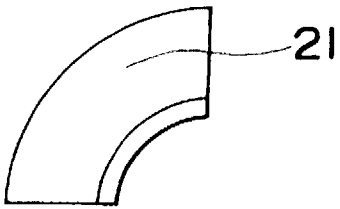
Figure 3E:
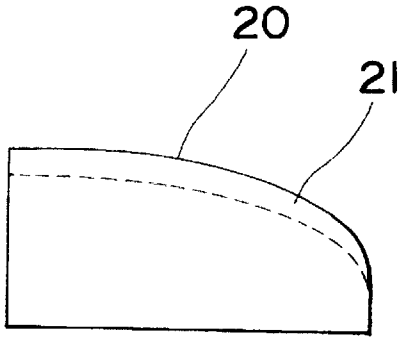

FIG. 3A is a front view of the whole combined components of a toroidally shaped pyrolytic graphite monochromator according to a further preferred embodiment of the present invention, and FIG. 3B is a side view of the whole. FIG. 3C is a front view of a component when the toroidally shaped pyrolytic graphite monochromator shown in FIGS. 3A and 3B is divided into four equivalent components, and FIG. 3D is its side view. FIG. 3E is a front view of a component when the toroidally shaped pyrolytic graphite monochromator shown in FIGS. 3A and 3B is divided into eight equivalent components, and FIG. 3F is its side view.

The above-mentioned heating and pressing process is a preliminary heat-treatment process prior to the hot-pressing process. At this stage, it is preferred to separately heat-treat the polymer films without stacking them on each other and in particular, it is preferred for the thickness of the films not to be more than 400 μm. This is because the stacked polymer films suppress gas release and this produces defects. After manufacturing carbonaceous films through the above-mentioned preliminary heat-treatment process, some carbonaceous films are stacked on each other, the hot-pressing process is carried out, and carbonaceous graphitization proceeds to take place. The films are divided into the equivalent parts from which a curved pyrolytic graphite is obtained by heating and pressing them against the isotropic graphite dies with a curved surface such as a paraboloid, a sphere, a cylinder and a toroid. These curved films are a part of a curved monochromator shown in FIGS. 1, 2, and 3A to 3F, for example.

When the graphite monochromator shown in FIGS. 3A and 3B is divided into the four equivalent components with respect to the center lines 41 and 43 in FIGS. 3A and 3B, each component is shown in FIGS. 3C and 3D, which is a toroidal graphite monochromator 18 of graphite crystal 19. Further, when the graphite monochromator shown in FIGS. 3A and 3B is divided into the eight equivalent components with respect to the center line 42 in the longitudinal direction in addition to the center lines 41 and 43 of FIGS. 3A and 3B, each obtained component is shown in FIGS. 3E and 3F, which is a toroidal graphite monochromator 20 of graphite crystal 21.

In the above-mentioned two cases, after combining the same components 19 or 20, a toroidal graphite monochromator 14 of graphite crystal 15 with incoming and outgoing ports 17 and 16 can be manufactured.

In the above-mentioned hot-pressing process, the pressure application method and temperature control are important. That is, in this hot-pressing process, it is necessary to press the films while removing wrinkles generated on the carbonaceous films during the heat treatment process. As a result of studies under such treatment conditions, in a temperature range from 400° to 2200° C., it is necessary to achieve pressure in a range from 10 to 20 kg/cm$^2$, and then applying pressure higher than that specified in this temperature range causes the carbonaceous film to crack. Not suddenly but slowly applying pressure is effective to prevent this cracking. In a temperature range from 2200° to 3500° C., pressure in a range from 20 to 1000 kg/cm$^2$ is required to realize complete installation, and, for example, at pressure lower than 20 kg/cm$^2$, pressing does not successfully take place.

Through the above-mentioned manufacturing process, there can be manufactured the curved pyrolytic graphite with a thick block form as well as with dramatically improved rocking characteristics. These curved graphites are processed as a part of a structure having one or more curved surfaces such as a paraboloid, a sphere, a cylinder, a toroid and the like. For example, after the above-mentioned POD films having thicknesses of 4, 25, 100 and 450 μm are heat-treated at 100° C. so as to produce the carbonaceous film, the films in relevant thicknesses are stacked in 10 pieces each, and the hot-pressing process applies 4 kg/cm$^2$ pressure in the heating process up to 2200° C. and applies 20 kg/cm$^2$ pressure in a temperature range of 2200° C. or over, and then performs the hot-pressing process for a predetermined time at 3000° C., to thereby manufacture curved graphite crystals.

Now discussion will be made on a method for manufacturing a thick curved graphite crystal, which partly differs from the above method and provides excellent rocking characteristics in the same manner.

With respect to the heat-treatment process for manufacturing polymer film material and carbonaceous films, it can be carried out in the same manner as in the manufacturing process of the above-mentioned sample, and the detailed description will be omitted. The manufacturing method of this example is characterized by applying pressure intermittently in a temperature range over 400° C. in the hot-pressing process. As described before, in the hot-pressing process of carbonaceous films, it is essential to define how successfully wrinkles and distortion generated by heat treatment should be removed, and the profile and setting methods of the isotropic graphite dies having a curved surface such as a parabolic, a spherical, a cylindrical and a toroidal surfaces, and the like are important. Based on this point, it is extremely effective to intermittently apply pressure. In order to obtain the curved monochromator shown in FIGS. 1, 2 and 3A to 3F, a curved pyrolytic graphite monochromator is manufactured by heating and pressing the films against the isotropic graphite dies having a curved surface such as a paraboloid, a sphere, a cylinder, and a toroid which are processed as a part of the structure thereof.

For applying continuous pressure, greater advantageous effects can be achieved by keeping the maximum pressure comparatively small in the low temperature range and increasing the maximum pressure in the high-temperature range during the heat-treatment process. The maximum pressure applied is most desirably 10 to 20 kg/cm$^2$ at temperature below 2200° C. At temperatures higher than 2200° C., 20 kg/cm$^2$ is preferable and the pressure exceeding 10 kg/cm$^2$ is acceptable.

In each example, in order to evaluate the degree of graphitization, the rocking characteristics are measured. The measuring conditions of these properties are shown as follows:

Rocking Characteristics

Using a Rotar Flex RU-200B type X-ray generator manufactured by Rigaku Denki, there was measured rocking characteristics at the 002 graphite peak.

EXAMPLE 2

Figure 4:
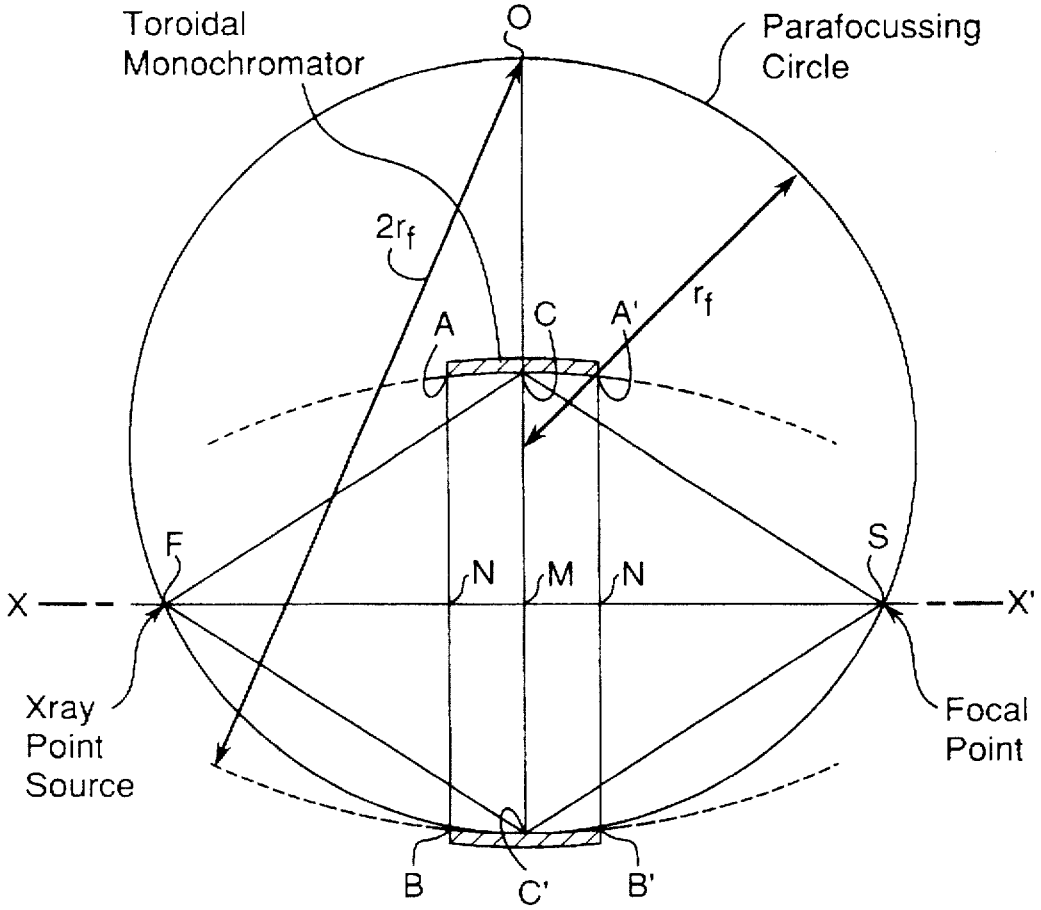
FIG. 4 is a schematic diagram for explanation of the principle of the convergent mechanism of x-ray beams with the toroidally curved pyrolytic graphite monochromator.

Referring to FIG. 4, the principle of a toroidally shaped graphite monochromator will be discussed.

FIG. 4 shows the principle of convergence of x-rays by a toroidal pyrolytic graphite monochromator. In FIG. 4, (a) F denotes a location of a focal point on an X-ray target;

(b) S denotes a location of a sample, namely the convergent point;

(c) Shaded area denotes a transverse section of a main body of the toroidal monochromator;

(d) FS denotes a passing path of the X-ray; and (e) O denotes the locations of centers of the parafocussing circle and of the curvature of the monochromator, respectively.

Consequently, the distance $\overline{FS}$ is a distance from the X-ray target to the sample which is a fixed parameter depending on the diffraction geometry. The radius of the parafocussing circle is computed from the following equations using the distance $\overline{FS}$, the wavelength λ of X-ray and the lattice spacing d of the layers along the c-axis in the graphite crystal. From the Bragg diffraction conditions, the scattering angle θ is given by the following equation:

$$\theta=\sin^{-1}(\lambda/2d) \quad (7),$$

where d is a spacing between the respective (002) planes of the graphite crystal and is 3.354 Å. Consequently, the radius $r_f$ is expressed by the following equation:

$$r_f=\overline{FS}/(2\sin 2\theta) \quad (8).$$

This radius $r_f$ gives a radius of the parafocussing circle in the horizontal plane of the toroidal graphite monochromator. The radius r at the center the toroidal monochromator is given, by the following equation.

$$r=(\overline{FS}/2)\tan\theta \quad (9),$$

The generated X-ray beams diverging from the focal point F are diffracted and monochromized by the graphite monochromator bent along the circle of $2r_f$ in a manner to satisfy the Bragg condition. These diffracted beams are converged to another focal point S.

Figure 5:
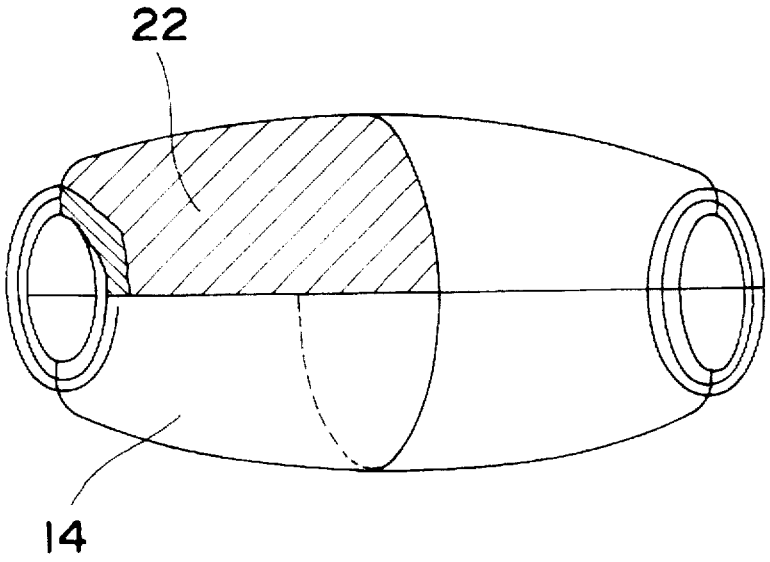
FIG. 5 is a schematic perspective view of the toroidal pyrolytic graphite monochromator when the monochromator is constructed with eight equivalent components shown in FIGS. 3E and 3F.

In designing the actual toroidally shaped graphite monochromator, description is made using the actual example shown in FIG. 5 as follows. It is to be noted that FIG. 5 shows a toroidal graphite monochromator 14 which is constructed with the eight components 22 shown in FIGS. 3E and 3F.

(1) As apparent from the Equation (8), the greater the scattering angle, the greater the horizontal curvature is. Consequently, the curvature decreases when the shorter X-ray wavelength is used for its design. This may ease the fabrication of the monochromator.

(2) The distance $\overline{FS}$ is a constant which depends on the diffraction geometry as described above. That is, the distance $\overline{FS}$ is determined by the size of the x-ray tube shield and a radius of a diffractometer. As apparent from the Equation (8), because the distance $\overline{FS}$ and the radius $r_f$ of the parafocussing circle are proportional to each other, the horizontal curvature decreases as the distance $\overline{FS}$ increases, thereby making forming still easier.

Specifically, referring to the case in which an X-ray tube for molybdenum Kα radiation was mounted to an X-ray generator manufactured by Rigaku Denki, and a diffractometer manufactured by Rigaku Denki was used, the size of toroidally shaped graphite monochromator was actually computed.

The X-ray tube is assumed to use a point focus having a size of 0.4 mm×8 mm. In the following case of:

Distance $\overline{FS}$=185 mm (measured value), and d (002 )=3.354 Å.

From the Equation (7), there can be obtained θ=6.082°. Consequently, from the Equation (8), the following is obtained:

$$r_f=438.9 \text{ mm},$$

Then, from the Equation (9), the largest radius r of the toroidal graphite monochromator CM=9.86 mm.

Figure 6:
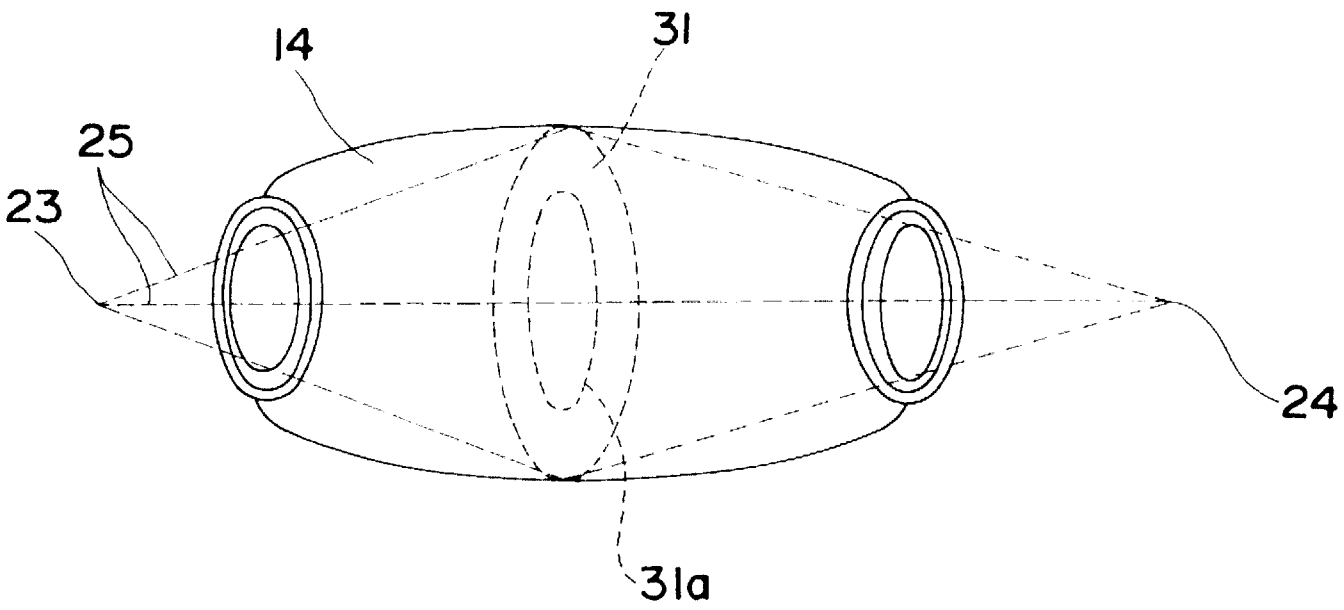
FIG. 6 is a schematic perspective view of the toroidal pyrolytic graphite monochromator showing the x-ray beam path from a point source in an x-ray generator through a diffraction surface of the monochromator to a focal point.

FIG. 6 shows a toroidal graphite monochromator 14 obtained in this way as well as the X-ray optical path diagram.

Referring to FIG. 6, X-rays 25 generated from an x-ray source 23 are incident into the toroidal graphite monochromator 14, and the x-rays 25 are diffracted and monochromized by an inner surface of the monochromator 14 having a toroidal shape and converged into a spot 24. In the present preferred embodiment, there can be obtained the monochromized and converged x-rays having an intensity of 100 times as large as the intensity in the conventional method with a pinhole slit. Furthermore, complete monochromatic beams are obtained by installing a beam stopper 31*a* for removing X-rays entering directly the focal point 24 from the x-ray source 23 in FIG. 6. Instead of the beam stopper, a foil filter can be used, for example, a Ni foil for CuKα radiation. In this case, x-rays directly entering the focal point from the source are monochromatized by the filter.

EXAMPLE 3

With 10-μm-thick POD, PA or PI polymer film sandwiched between graphite sheets, respectively, they were heated to 1000° C. at a heating rate of 20° C. per minute in a nitrogen atmosphere and kept for one hour at 1000° C., and then, carbonaceous films are obtained.

The carbonaceous films comprising the respective relevant materials are stacked in 20 sheets and hot-pressed by a super-high-temperature hot press apparatus manufactured by Chugairo Kogyo in Osaka Japan, and then, graphite blocks are obtained. The processing conditions of the hot-press process are as follows: the film is heated at a heating rate of 10° C. per minute and with pressure applied in a temperature range from 1000° to 2200° C., the film is heated and pressed to an isotropic graphite die with a predetermined shape, that is, the curved monochromator shown in FIGS. 1 and 2, or a part of the toroidal graphite monochromator divided into the four or eight components as it is shown in FIGS. 3C, 3D, 3E, and 3F. Thereafter, pressure is gradually increased up to 20 kg/cm$^2$. At temperature above 2800° C., the pressure is kept at 40 kg/cm$^2$, and then, the film is pressed at 3000° C. for one hour. The physical properties vary depending upon the shape of isotropic graphite dies with a curved surface.

The rocking characteristics estimated as a rotation angle [°] in the curved graphite obtained in this way and those of the graphite actually manufactured under the above-mentioned processing conditions are 0.60° at a POD film thickness of 4 μm, 0.80° at a POD film thickness of 25 μm, 1.5° at a POD film thickness of 100 μm, and 1.8° at a POD film thickness of 450 μm. As a result, this exhibits remarkable improvement in the rocking characteristics as compared with the conventional characteristics.

As described above, the manufacturing method of the curved pyrolytic graphite monochromator according to this invention is very new in its concept and epoch-making in studies which requires a small high intensity beam, such as biology research and property research.

This is achieved by an excellent process in which specific polymer films are stacked to obtain highly crystallized graphite. Specifically, polymer films having a thickness in a range from 1 to 400 μm and being made of a compound selected from the group consisting of polybenzothiazole, polybenzobisthiazole, polybenzoxazole, polybenzobisoxazole, polyamideimide, polybenzoimidazole, polybenzobisimidazole, polyterephthalamide, polyphenylene vinylene, aromatic polyimide, aromatic polyamide, and polyoxadiazole are heat-treated to prepare carbonaceous film, and then, the carbonaceous film produced independently by itself or at stack of the carbonaceous films obtained are intermittently subjected to pressure exceeding 10 kg/cm$^2$, and heated at 400° C. or higher and pressed onto dies with a predetermined curved surface such as parabolic, spherical, cylindrical and toroidal surfaces. This is an epoch-making manufacturing method for forming a pyrolytic graphite monochromator with at least one or more curved diffraction surface profiles obtained in this way.

In particular, in the case of toroidally shaped graphite crystal monochromator 14, only mounting to the conventional X-ray source achieves marvelous advantageous effects of obtaining over 100 times higher intensity than the X-rays with a pinhole slit. The dies with a predetermined curved surface such as parabolic, a spherical, cylindrical and toroidal surfaces exhibit advantageous effects to prevent damage to a pressurizing shaft at high temperatures and baked graphite crystal by using a die specially designed to apply pressure while the pressure in the pressurizing stress direction is less dispersed in other directions.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A method for manufacturing a curved pyrolytic graphite x-ray monochromator comprising the following steps:

heating one or more pieces of polymer films at a temperature predetermined in a range from 400° C. to 3500° C. so as to form one or more carbonaceous films; and heating and pressing one or more pieces of formed carbonaceous films superimposed onto a predetermined curved surface of a isotropic graphite die at a temperature predetermined in a range from 400° C. to 3500° C., while applying a pressure predetermined in a range from 10 kg/cm$^2$ to 1000 kg/cm$^2$ onto the carbonaceous films provided on said isotropic graphite die, thereby forming said curved pyrolytic graphite x-ray monochromator of graphite crystal having a resulting curved surface corresponding to the predetermined curved surface. a pressure predetermined in a range from 10 kg/cm$^2$ to 1000 kg/cm$^2$ onto the carbonaceous films provided on said isotropic graphite die, thereby forming said curved pyrolytic graphite x-ray monochromator of graphite crystal having a resulting curved surface corresponding to the predetermined curved surface.

2. The method as claimed in claim 1, wherein the said pressure is set to a pressure in a range from 10 kg/cm$^2$ to 20 kg/cm$^2$ when heating said carbonaceous films at a temperature in a range from 400° C. to 2200° C., and wherein said pressure is set to a pressure in a range from 20 kg/cm$^2$ to 1000 kg/cm$^2$ when heating said carbonaceous films at a temperature in a range from 2200° C. to 3500° C.

3. The method as claimed in claim 1, wherein each of said polymer films is made of a compound selected from the group consisting of polybenzothiazole, polybenzobisthiazole, polybenzoxazole, polybenzobisoxazole, polyamideimide, polybenzoimidazole, polybenzobisimidazole, polyterephthalamide, polyphenylene vinylene, aromatic polyimide, aromatic polyamide, and polyoxadiazole.

4. The method as claimed in claim 1, wherein said resulting curved surface is a parabolic surface.

5. The method as claimed in claim 1, wherein said resulting curved surface is a sphere.

6. The method as claimed in claim 1, wherein said resulting curved surface is a toroidal surface.

7. The method as claimed in claim 1, wherein said resulting curved surface is a cylindrical surface.

* * * * *